US006346789B1

(12) United States Patent
Bird et al.

(10) Patent No.: US 6,346,789 B1
(45) Date of Patent: Feb. 12, 2002

(54) MOTOR STEP-LESS SPEED CONTROL WITH ACTIVE FEEDBACK OF PHASE DETECTOR

(75) Inventors: Douglas D. Bird, Little Canada; Brent Chian, Plymouth, both of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/450,077

(22) Filed: Nov. 29, 1999

(51) Int. Cl.[7] ..... H02N 3/00

(52) U.S. Cl. ..... 318/480; 318/268; 310/307; 431/80; 388/907.5; 388/917

(58) Field of Search ..... 318/244, 245, 318/268, 437, 438, 480; 388/907.5, 917; 431/78, 80; 126/500, 307 R, 312, 80; 310/306, 307

(56) References Cited

U.S. PATENT DOCUMENTS

| | | | | | |
|---|---|---|---|---|---|
| 4,778,378 | A | * | 10/1988 | Dolnick et al. | 431/79 |
| 4,984,981 | A | * | 1/1991 | Pottebaum | 431/80 |
| 5,931,655 | A | * | 8/1999 | Maher, Jr. | 431/14 |
| 6,053,163 | A | * | 4/2000 | Bass | 126/312 |

FOREIGN PATENT DOCUMENTS

| | | |
|---|---|---|
| JP | 56022623 | 8/1982 |
| JP | 08132923 | 11/1996 |
| JP | 08327233 | 6/1998 |

* cited by examiner

*Primary Examiner*—Bentsu Ro

(57) ABSTRACT

An apparatus for and method of controlling the circulating fan of a gas appliance. The circulating fan is powered by an alternating current electric motor. An electronic circuit, powered by the heat of the gas appliance, determines the rotational speed of the electric motor by controlling the effective duty cycle of the alternating current source coupled to the electric motor.

18 Claims, 4 Drawing Sheets

MOTOR STEP-LESS SPEED CONTROL WITH ACTIVE FEEDBACK OF PHASE DETECTOR

CROSS REFERENCE TO CO-PENDING APPLICATIONS

U.S. patent application Ser. No. 09/447,611, filed Nov. 23, 1999, and entitled "LOW INPUT VOLTAGE, LOW COST MICRO-POWER DC-DC CONVERTER"; U.S. patent application Ser. No. 09/447,999, filed Nov. 23, 1999, and entitled, "STEPPER MOTOR DRIVING A LINEAR ACTUATOR OPERATING A PRESSURE CONTROL REGULATOR"; U.S. patent application Ser. No. 09/448,102, filed Nov. 23, 1999, and entitled, "LOW INPUT VOLTAGE, HIGH EFFICIENCY, DUAL OUTPUT DC TO DC CONVERTER"; and U.S. patent application Ser. No. 09/448,000, filed Nov. 23, 1999, and entitled "ELECTRONIC DETECTING OF FLAME LOSS BY SENSING POWER OUTPUT FROM THERMOPILE" (now abandoned) are commonly assigned co-pending applications incorporated herein by reference.

BACKGROUND OF THE INVENTION

1. Field of the Invention

The present invention generally relates to systems for control of a gas appliance and more particularly relates to electronic control of an auxiliary electric motor.

2. Description of the prior art

It is known in the art to employ various appliances for household and industrial applications which utilize a fuel such as natural gas (i.e., methane), propane, or similar gaseous hydrocarbons. Typically, such appliances have the primary heat supplied by a main burner with a substantial pressurized gas input regulated via a main valve. Ordinarily, the main burner consumes so much fuel and generates so much heat that the main burner is ignited only as necessary. At other times (e.g., the appliance is not used, etc.), the main valve is closed extinguishing the main bumer flame.

A customary approach to reigniting the main burner whenever needed is through the use of a pilot light. The pilot light is a second, much smaller burner, having a small pressurized gas input regulated via a pilot valve. In most installations, the pilot light is intended to burn perpetually. Thus, turning the main valve on provides fuel to the main burner which is quickly ignited by the pilot light flame. Turning the main valve off, extinguishes the main burner, which can readily be reignited by the presence of the pilot light.

These fuels, being toxic and highly flammable, are particularly dangerous in a gaseous state if released into the ambient. Therefore, it is customary to provide certain safety features for ensuring that the pilot valve and main valve are never open when a flame is not present preventing release of the fuel into the atmosphere. A standard approach uses a thermogenerative electrical device (e.g., thermocouple, thermopile, etc.) in close proximity to the properly operating flame. Whenever the corresponding flame is present, the thermocouple generates a current. A solenoid operated portion of the pilot valve and the main valve require the presence of a current from the thermocouple to maintain the corresponding valve in the open position. Therefore, if no flame is present and the thermocouple(s) is cold and not generating current, neither the pilot valve nor the main valve will release any fuel.

In practice, the pilot light is ignited infrequently such as at installation, loss of fuel supply, etc. Ignition is accomplished by manually overriding the safety feature and holding the pilot valve open while the pilot light is lit using a match or piezo igniter. The manual override is held until the heat from the pilot flame is sufficient to cause the thermocouple to generate enough current to hold the safety solenoid. The pilot valve remains open as long as the thermocouple continues to generate sufficient current to actuate the pilot valve solenoid.

The safety thermocouple(s) can be replaced with a thermopile(s) for generation of additional electrical power. This additional power may be desired for operating various control circuitry of equipment auxiliary to the gas appliance. Normally, this requires conversion of the electrical energy produced by the thermopile to a voltage usefull to these additional loads. Though not suitable for this application, U.S. Pat. No. 5,822,200, issued to Stasz; U.S. Pat. No. 5,804,950, issued to Hwang et al.; U.S. Pat. No. 5,381,298, issued to Shaw et al.; U.S. Pat. No. 4,014,165, issued to Barton; and U.S. Pat. No. 3,992,585, issued to Turner et al. all discuss some form of voltage conversion.

For gas appliances intended to provide space heating, it is customary to employ auxiliary circulating components, such as electric motor powered fans. Typically, such auxiliary circulating components are controlled using manually operated switches.

SUMMARY OF THE INVENTION

The present invention overcomes the disadvantages of the prior art by providing a totally electronic technique for the control of an auxiliary circulating fan within a gas appliance. In the preferred mode of the present invention, the gas appliance is a gas fireplace. Room air is circulated through the heat exchanger of the gas fireplace by an electric motor powered air circulating fan. Though the fan is powered by the normal alternating current found in the home, the control circuits are all powered by heat from the pilot light flame. The rotational speed of the electric motor, and therefore the amount of air circulation, is continuously selectable by the control circuitry.

In accordance with the preferred mode of the present invention, a thermopile is thermally coupled to the pilot flame. As current is generated by the thermopile, it is converted via a DC-to-DC converter to a regulated output and an unregulated output. The regulated output powers a microprocessor and other electronic circuitry which control operation of the main fuel valve, remote communication with the operator, and speed of the circulating fan. The unregulated output powers various mechanical components including a stepper motor which controls the main burner valve.

The circulating fan electric motor is powered by the 110 volt a.c. line. The circuitry of the present invention regulates the effect duty cycle of this line input to regulate the rotational speed. A phase detector senses the line input and notifies the microprocessor of the timing of the zero crossing of the 110 volt signal. The microprocessor turns a triac to the on state to power the electric motor after a suitable delay period. Increasing the delay period decreases the effective duty cycle and therefore slows the operational speed. Decreasing the delay period, increases the speed.

Because the microprocessor operates in digitally clocked sequences, the speed variations are actually made in discrete steps, even though these discrete steps are so small as to make the speed variations seem continuous. However, the present invention can also be implemented using analog control, if completely continuous speed control is required. In the preferred system, six individual discrete steps are used to simplify the operator interface.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
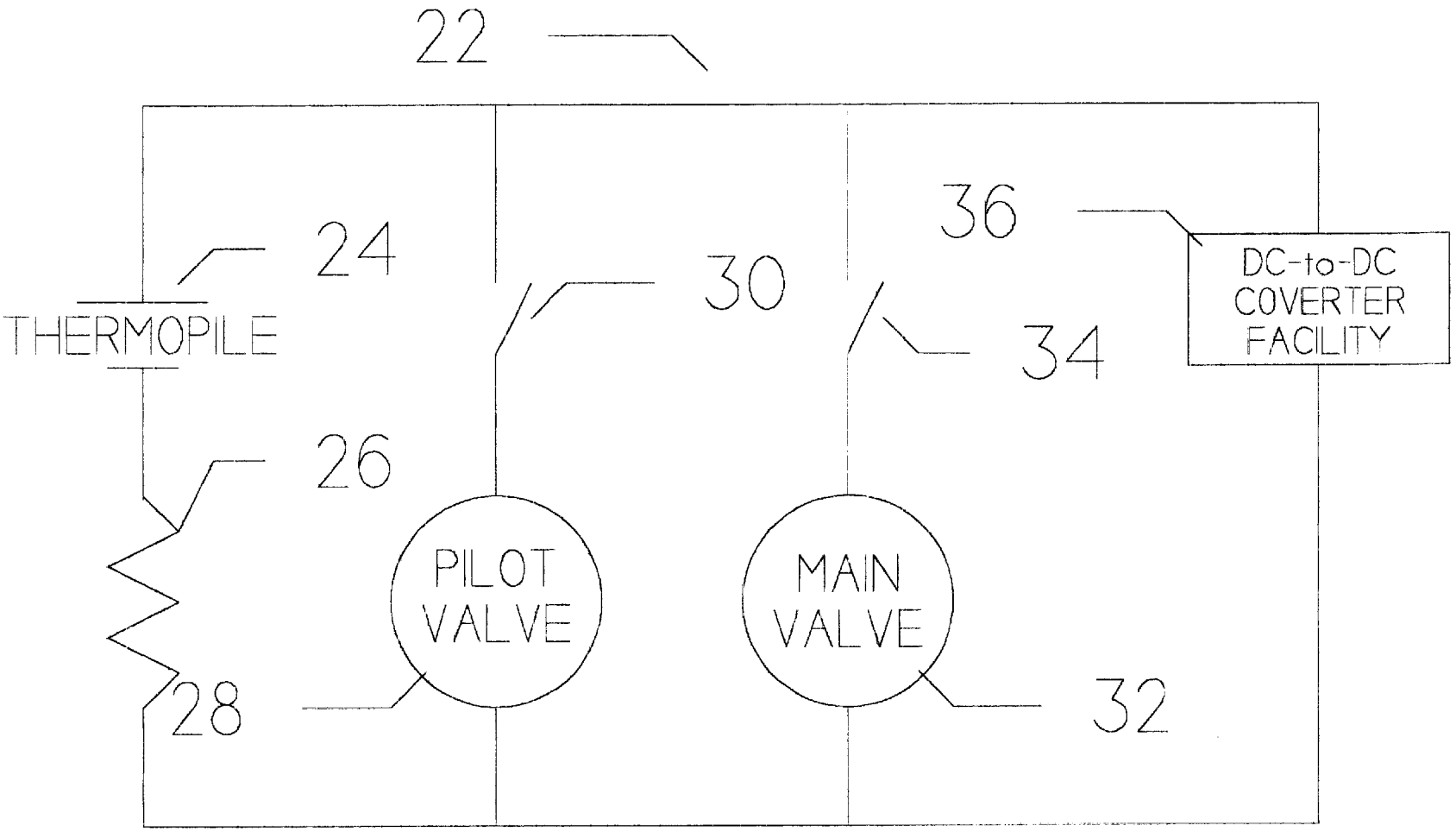
FIG. 1 is a simplified electrical schematic diagram of the present invention.

FIG. 1 is a very basic electrical diagram 22 of the power circuitry of the present invention. Thermopile 24 is structured in accordance with the prior art. Resistor 26 represents the internal resistance of thermopile 24.

Pilot valve 28 has a solenoid (not separately shown) which holds the pilot valve open whenever sufficient current flows through the circuit. Similarly, the internal solenoid (also not separately shown) of main valve 32 holds the main valve open whenever sufficient current flows through the associated circuit.

DC-to-DC conversion facility 36 converts the relatively low voltage output of thermopile 24 to a sufficiently large voltage to power the electronic control circuitry, including the microprocessor. In accordance with the preferred mode of the present invention, DC-to-DC conversion facility 36 consists of two DC-to-DC converters. The first converter operates at the extremely low thermopile output voltages experienced during combustion chamber warm up to generate a higher voltage to start the high-efficiency, second DC-to-DC converter. The other DC-to-DC converter, once started, can keep converting at much lower input voltage and generate much more power from the limited thermopile output for the system during normal operation. A more detailed description of the second device is available in the above identified and incorporated, commonly assigned, co-pending U.S. Patent Applications.

Figure 2:
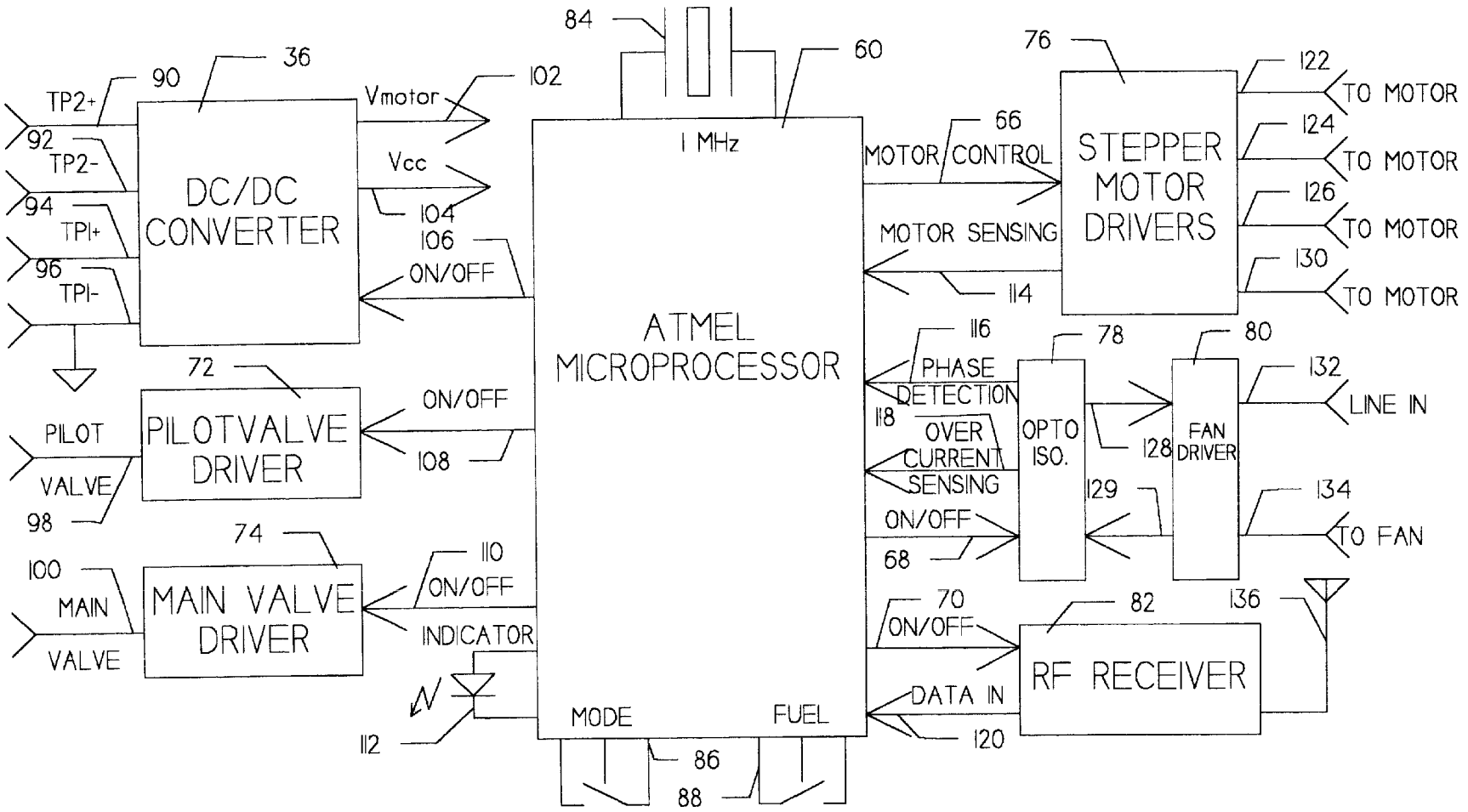
FIG. 2 is a detailed block diagram of the microprocessor of the present invention.

FIG. 2 is a detailed diagram showing the basic inputs and outputs of microprocessor 60. In the preferred mode, microprocessor 60 is an 8-bit AVR model AT90LS8535 microprocessor available from ATMEL. It is a high performance, low power, restricted instruction set (i.e., RISC) microprocessor. In the preferred mode, microprocessor 60 is clocked at one megahertz to save power, even though the selected device may be clocked at up to four megahertz. One megahertz crystal 84 clocks microprocessor 60. The output of crystal 84 is also divided down to provide an interrupt to microprocessor 60 once per second. This interval is utilized for sampling of the thermopile output voltage Indicator 112 permits early notification of flame on to the user.

Manual mode switch 86 permits an operator to select local mode or remote mode. Similarly, manual switch 88 is used to select the input fuel type, so that the main valve outlet pressure can be adjusted accordingly for propane and methane. Each of these alternative switch positions cause microprocessor 60 to consult a particular corresponding entry within the valve positioning table stored in the non-volatile memory of microprocessor 60. These entries provide the necessary information for microprocessor to direct the stepper motor to set the main burner valve outlet pressure to the proper value. The method for determining the valve positioning table entries is described in detail below.

DC-to-DC converter 36 can receiver inputs from up to two thermopiles. Inputs 94 and 96 provide the positive and negative inputs from the first thermopile, whereas inputs 90 and 92 provide the positive and negative inputs from the second thermopile, respectively. Output 102 is the unregulated output of DC-to-DC converter 36. This output has a voltage varying between about 6 volts and 10 volts. The unregulated output powers the mechanical components, including the stepper motor. Line 104 is a 3 volt regulated output. It powers microprocessor 60 and the most critical electronic components. Line 106 permits microprocessor to turn DC-to-DC converter 36 on and off. This is consistent with the voltage sampling and analysis by microprocessor 60 which predicts flame out conditions.

Line 72 enables and disables pilot valve driver 72 coupled to the pilot valve via line 98. Similarly, line 110 controls main valve driver 74 coupled to the main valve via line 100. This is important because microprocessor 60 can predict flame out conditions and shut down the pilot and main valves long before the output of the thermopile is insufficient to hold the valves open. A more detailed description of this significant feature may be found in the above referenced, co-pending pending, commonly assigned, and incorporated U.S. patent applications.

Stepper motor drivers 76 are semiconductor switches which permit the output of discrete signals from microprocessor 60 to control the relatively heavy current required to drive the stepper motor. In that way, line 66 controls the stepper motor positioning in accordance with the direction of the microprocessor firmware. Line 114 permits sensing of the stepper motor status. Lines 122, 124, 126, and 130 provide the actual stepper motor current.

In the preferred mode of practicing the present invention, the gas appliance is a fireplace. The thermopile output is not sufficient to power the desired fan. However, the system can control operation of the fan. Therefore, line 132 provides the external power which is controlled by fan driver 80. Lines 128 and 129 couple to optical isolation device 78 for coupling via lines 68, 116, and 118 to microprocessor 60. Line 134 actually powers the fan. This control scheme is explained in more detail below.

The fireplace of the preferred mode also has radio frequency remote control. A battery operated transmitter communicates with rf receiver 82 via antenna 136. Lines 70 and 120 provide the interface to microprocessor 60. Rf receiver 82 is powered by the 3 volt regulated output of DC-to-DC converter 36 found on line 104.

Figure 3:
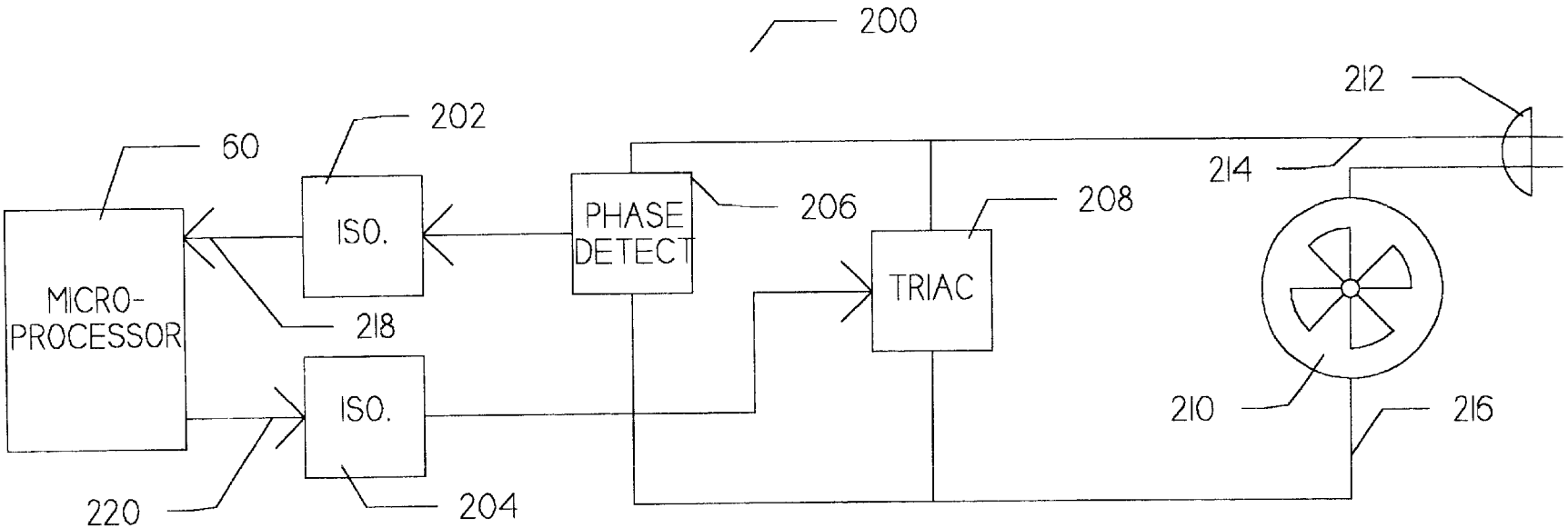
FIG. 3 is a detailed electrical schematic diagram of the control circuitry.

FIG. 3 is an electrical schematic diagram showing the operation of the circulating fan speed control circuitry. Standard electrical plug 212 is inserted into the 110 volt ac line receptacle in the known manner. Line 214 conducts one side of the circuit to triac 208 which acts as a switch to open and close the motor circuit. Triac 208 is coupled to fan motor 210 via line 216. The circuit is completed to standard plug 212 as shown.

Thus, whenever triac 208 closes the circuit, fan motor 210 receives electrical power and fan motor 210 is caused to rotate. Whenever triac 208 is open, fan motor 210 receives no power. Thus, triac 208 can operate as an on/off switch. In accordance with the present invention, triac 208 can also be switched on and off rapidly to control the speed of fan motor 210 as explained in more detail below.

Phase detector 206 is coupled to and senses the 110 volt ac line. As explained below, it is able to signal microprocessor 60 via optical isolator 202 and line 218 of the zero crossings of the periodic 110 volt ac line. As explained below, the present invention relies upon notification to microprocessor 60 of a same point in this period signal, and zero crossing is a convenient point.

Microprocessor 60 turns triac 208 on and off via the state of line 220. This signal is passed through optical isolator 204 which, as with optical isolator 202, prevents damage to microprocessor 60 by 110 volt ac line surges.

Figure 4:
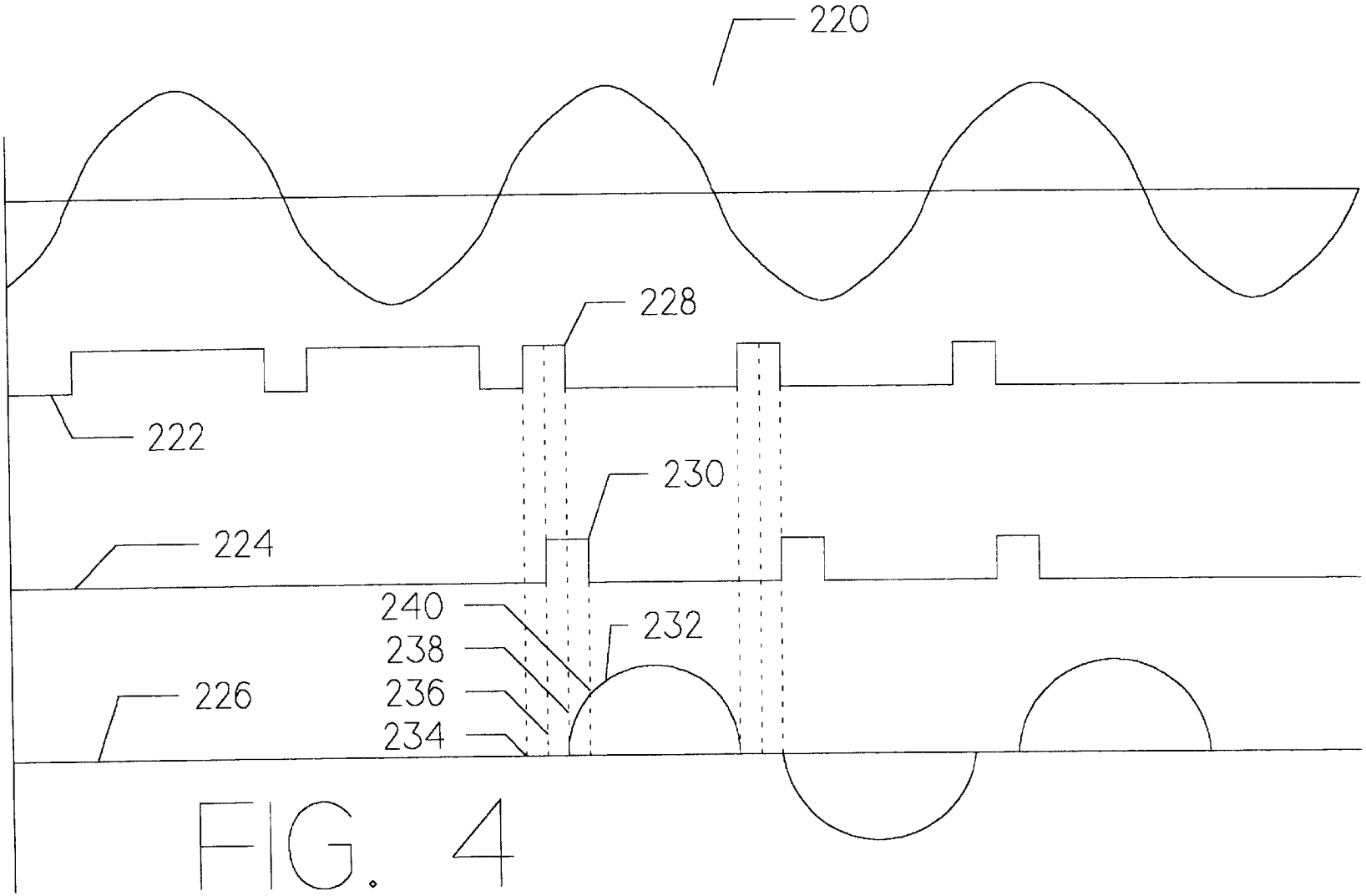
FIG. 4 is a timing diagram showing the key signals.

FIG. 4 is a diagram showing the timing relationships of the various key signals of the present invention. Signal 220 is the characteristic sine wave tracing the voltage of the 110 ac line. Signal 222 is the output of phase detector 206 as presented to microprocessor 60 via optical isolator 202 and line 218 (see also FIG. 3). Signal 224 is the control signal sent to triac 208 from microprocessor 60 via line 220 and optical isolator 204. Signal 226 is the current flowing through fan motor 210.

Time 234 represents a zero crossing of the 110 volt ac line corresponding to the leading edge of pulse 228. This pulse is generated by phase detector 206 and is presented to microprocessor 60 as described above. The time lag between time 234 and time 236 is a variable delay determined by microprocessor 60. At time 236, microprocessor 60 generates pulse 230 to turn on triac 208. As a result of the triac having been turned on, phase detector 206 changes state at time 238 defining the trailing edge of pulse 228. Microprocessor 60 senses the trailing edge of pulse 228 (i.e., the change of state of phase detector 206) and after a predetermined delay turns off the triac control signal defining the trailing edge of pulse 230 at time 240. This way the triac trigger pulse width is minimized to conserve power.

Signal 226 shows the current flowing through fan motor 210. As can be seen from half wave curve 232, this current draw exists for less than the corresponding half cycle of signal 220, because the current draw is shortened by the delay between time 234 and time 236. Thus, the effective duty cycle of the current flowing through fan motor 210 and, hence the rotational speed, is controlled by the delay between time 234 and time 236. In accordance with the preferred mode of the present invention, six separate and discrete delays are stored within the memory of microprocessor 60. This provides six different circulating fan speeds. This is deemed sufficient for the present application.

It should be observed that before the motor is powered, the phase detection can detect the AC line voltage zero-crossing with very little delay. However, after the triac is turned on in any given line voltage cycle, the phase detection will no longer detect the zero-crossing of the line voltage, but will detect the fan motor current zero crossing time which is delay from the line voltage zero-crossing time. Line voltage, fan motor specification, and triac triggering time will all effect the delay. The microprocessor will keep a time base and dynamically adjust the delay time.

The present invention could be employed in a half wave fashion, detecting only one rather than two zero crossings per cycle. This would decrease the cost but also decrease the range of control. Furthermore, instead of zero crossing detection of phase detector 206, any other convenient and repeatable point in the cycle could be chosen for notification to microprocessor 60.

Having thus described the preferred embodiments of the present invention, those of skill in the art will be readily able to adapt the teachings found herein to yet other embodiments within the scope of the claims hereto attached.

We claim:

1. In an appliance having a flame and having a circulating fan, the improvement comprising:

a. an electronic control circuit, powered by said flame, which controls the speed of said circulating fan.

2. The improvement according to claim 1 wherein said circulating fan is powered by an alternating current source.

3. The improvement according to claim 2 wherein said electronic control circuit further comprises a microprocessor.

4. The improvement according to claim 3 wherein said electronic control circuit further comprises a switch responsively coupled to said microprocessor for connecting and disconnecting said alternating current source from said circulating fan.

5. The improvement according to claim 4 wherein said electronic control circuit further comprise a circuit for notifying said microprocessor of a given point within the cycle of said alternating current source.

6. An apparatus comprising:

a. a gas appliance having a flame;

b. a circulating fan; and c. an electronic circuit, powered by said flame, which controls the speed of said circulating fan.

7. An apparatus according to claim 6 wherein said circulating fan is powered by an alternating current source.

8. An apparatus according to claim 7 wherein said electronic circuit controls the effective duty cycle of said alternating current source powering said circulating fan.

9. An apparatus according to claim 8 wherein said electronic circuit further comprises a microprocessor.

10. An apparatus according to claim 9 wherein said flame further comprises a pilot light.

11. A method of controlling the rotational speed of a circulating fan within a gas appliance having a flame comprising:

a. powering an electronic circuit by said flame; and b. controlling said rotational speed of said circulating fan with said electronic circuit.

12. A method according to claim 11 wherein said controlling step further comprises:

a. powering said circulating fan from an alternating current source; and b. maintaining the effective duty cycle of said alternating current source.

13. A method according to claim 12 wherein said maintaining step further comprises:

a. connecting said alternating current source to said circulating fan during a first portion of said alternating current source cycle; and b. disconnecting said alternating current source to said circulating fan during a second portion of said alternating current source cycle.

14. A method according to claim 13 wherein said maintaining step further comprises sensing a particular point of said alternating current source cycle.

15. A method according to claim 14 wherein said maintaining step further comprises delaying for a time between said sensing step and said connecting step.

16. An apparatus comprising:

a. means for producing a flame;

b. means for circulating air;

c. means responsively coupled to said producing means and said circulating means and powered by said flame for controlling said circulating means;

d. wherein said controlling means further comprises an electronic circuit; and e. wherein said controlling means further comprises a microprocessor.

17. An apparatus according to claim 16 wherein said circulating means further comprises a fan having an electric motor.

18. An apparatus according to claim 17 wherein said electric motor is powered by an alternating current source.

* * * * *